US005516586A

United States Patent [19]

Singer et al.

[11] Patent Number: 5,516,586

[45] Date of Patent: May 14, 1996

[54] METHOD FOR PROTECTING A METAL SURFACE

[75] Inventors: Alfred R. E. Singer, Swansea; Allen D. Roche, Mid-Glamorgan; Gordon I. Davies, Swansea, all of Wales

[73] Assignee: Sprayforming Developments, Swansea, Wales

[21] Appl. No.: 162,203

[22] PCT Filed: Jun. 11, 1992

[86] PCT No.: PCT/GB92/01052

§ 371 Date: Dec. 7, 1993

§ 102(e) Date: Dec. 7, 1993

[87] PCT Pub. No.: WO92/22676

PCT Pub. Date: Dec. 23, 1992

[30] Foreign Application Priority Data

Jun. 11, 1991 [GB] United Kingdom ..... 9112499

[51] Int. Cl.[6] ..... B32B 15/04

[52] U.S. Cl. ..... 428/433; 428/209; 428/210; 428/469; 428/471; 428/472; 428/539.5; 428/697; 428/701; 428/702; 148/403; 148/516; 148/537; 427/192; 427/205; 427/330; 427/367; 427/404; 427/405; 427/419.2; 427/419.6; 427/422; 427/456

[58] Field of Search ..... 428/630, 631, 428/633, 469, 471, 472, 428, 433, 697, 701, 702, 539.5; 148/537, 516, 403; 427/192, 193, 205, 328, 330, 367, 405, 419.2, 419.6, 422, 427, 456

[56] References Cited

U.S. PATENT DOCUMENTS

| | | | |
|---|---|---|---|
| 3,475,141 | 10/1969 | Hubbell | 428/631 |
| 3,482,951 | 12/1969 | Hubbell | 428/631 |
| 3,754,976 | 8/1973 | Babecki | 427/192 |
| 3,956,028 | 5/1976 | Boggs | 428/471 |
| 4,309,485 | 1/1982 | Kondo | 428/471 |
| 4,552,784 | 11/1985 | Chu | 427/192 |
| 4,689,271 | 8/1987 | Shittenhelm | 428/702 |
| 4,724,165 | 2/1988 | Schnettler | 427/193 |
| 4,740,388 | 4/1988 | Nakashima | 427/193 |
| 4,959,330 | 9/1990 | Donohue | 428/702 |
| 5,037,670 | 8/1991 | Kuo | 427/192 |

*Primary Examiner*—Ellis P. Robinson
*Assistant Examiner*—Timothy M. Speer
*Attorney, Agent, or Firm*—Cooper & Dunham

[57] ABSTRACT

Protection of a metal surface is carried out by applying a coating of vitreous enamel to the surface so that the enamel forms a strong bond with the metal and then spraying a coating of an atomized protective metal on the enamel. Preferably a peening operation is carried out on the surface of the sprayed metal simultaneously with or immediately after the spraying of the metal. The method is particularly advantageous in protecting steel marine structures against corrosion and, where the protective metal is cupro-nickel, fouling by marine creatures. The vitreous enamel forms an electrically insulating layer preventing galvanic action between the steel and the cupro-nickel in the presence of sea water.

9 Claims, 1 Drawing Sheet

METHOD FOR PROTECTING A METAL SURFACE

BACKGROUND OF THE INVENTION

This invention concerns the protection of metal surfaces against corrosion.

According to the invention there is provided a method of protecting a metal surface comprising the steps of coating the surface with vitreous enamel, spraying an atomized protective metal or alloy whilst the enamel is in a hot viscous condition thereby to form a layer of the protective metal or alloy on the enamel, and carrying out a spray peening operation on the layer of protective metal or alloy whilst the protective metal or alloy is in a hot condition.

The invention also provides an article or structure having at least part of a metallic surface thereof coated with a vitreous enamel, the coating of enamel having applied thereto a spray-coated layer of a protective metal or alloy, with penetration of the enamel at the interface between the enamel and the protective metal or alloy, the protective metal or alloy layer being peened.

Corrosion is a major hazard where articles or structures are required to operate for long periods under adverse weather conditions, particularly marine conditions. Typical cases are those of marine oil platforms and ships.

In the case of marine oil platforms the structure can be weakened, particularly near the waterline and in the splash zone. Painting of the structure is not of itself sufficient protection and sacrificial anodes of zinc are frequently used to diminish corrosion in the danger areas. Despite the use of antifouling paint the formation of barnacles causes further problems because it increases the drag on the structure caused by waves and water currents.

Similar problems occur with ships although the liberal use of antifouling paints and the relative simplicity of inspection ease the problem somewhat.

Many other solutions to the problem of corrosion have been tried including cladding with cupro-nickel or other corrosion resistant metals. This has the special advantage of presenting the seawater side of the combination with a corrosion resistant surface which is toxic to barnacles and therefore permanently antifouling. Unfortunately cupro-nickel and steel form a galvanic cell in the presence of sea water leading to severe corrosion of the steel if penetration of the cupro-nickel occurs. An intermediate layer of rubber can be used to prevent such penetration and separate the components of the galvanic cell but to be effective it must be thick and it is therefore expensive and bulky.

SUMMARY OF THE INVENTION

The method according to the invention allows a steel structure to be coated with, for example, cupro-nickel which is separated by a thin and cheap electrically insulating layer from the steel structure thus giving it effective corrosion protection in any area required and at the same time having antifouling properties.

More specifically the method comprises the steps of covering parts of a steel structure with a protective coating consisting firstly of a coating of vitreous enamel and secondly of a layer of a corrosion resistant metal or alloy applied as a metal spray, the first coating of vitreous enamel being heated to a temperature at which it flows over the steel surface and bonds to it, the composition of which vitreous enamel is selected such that it is softened and is viscous at the spraying temperature of the layer of metal or alloy, with the effect that the spray coating of corrosion resistant metal or alloy bonds to the vitreous enamel but the sprayed metal droplets do not penetrate the vitreous enamel completely, and spray peening the layer of metal or alloy. The sprayed layer of corrosion resistant metal can be applied by metal spraying using a thermal spray gun, plasma arc spray or spray from an atomised melt of corrosion resistant metal, or alternatively the process of simultaneous spray peening described in British Patent No. 1605035 can be used in which latter case a smooth pore-free external surface having controlled internal stress can be produced.

Vitreous enamelling is a well-known and much used procedure but the combination of vitreous enamelling with metal spray coating or simultaneous spray peening brings about particular and unexpected benefits in the area of marine corrosion protection.

Much of the corrosion protection in the case of large structures has to be done on site. In these cases, using the invention, the enamel frit can be applied to the steel structure either by painting or more often by spraying as in the conventional vitreous enamelling of large surfaces. The enamel is then fused to the surface of the steel structure by surface heating with high frequency induction heaters or using a thermal or plasma torch. Typically, the thickness of the enamel is in the range 100–500 μm. For marine use, it is preferred to employ enamel thicknesses at the upper end of the range and even up to 1 mm.

Vitreous enamels are always carefully compounded to give both good adhesion to steel and a good resistance to thermal cycling, which is advantageous in the present invention. Vitreous enamel provides a hard corrosion resistant and electrically Insulating coating on the steel. It is also strong in compression and able to withstand accidental impacts by ships, tools etc. especially when coated with 1–5 mm of a ductile metal such as copper nickel.

The next layer applied to the enamelled steel is a spray coating of corrosion resistant metal, preferably cupro-nickel. The enamelled surface is heated by the spray gun being used and by the spray of hot metal particles Impinging at high speed on the enamel. At these elevated temperatures the enamel is relatively soft so that the early particles of metal spray partially penetrate and adhere to the outer skin of the vitreous enamel. The remaining particles of the metal spray build up to form a layer which typically may be between 1 and 5 mm in thickness.

While the above metal coating is corrosion resistant, antifouling and strongly adhesive to the enamel, it is relatively porous, a typical porosity being 5%, and slightly rough on the outside surface.

Great reductions in the porosity, external, surface roughness and the internal stress in the coating, can be achieved by using the process of simultaneous spray peening described in British Patent No. 1605035 for the deposition of at least the last part of the sprayed metal coating. In a typical arrangement the first 1 mm consists of a normal spray deposit of cupro-nickel followed by a 2 mm thickness of a spray peened deposit of cupro-nickel.

Such composite coatings on the steel structure are relatively cheap to apply, are not bulky, give a high measure of corrosion protection and are resistant to accidental damage.

Repair of areas where the coating may have been removed is carried out by repeating the process outlined above on the affected area. The fact that some of the newly applied enamel may cover part of the existing sprayed metal coating is unimportant since the enamel will adhere to the old metal spray coating and the new metal spray coating will also adhere to the enamel.

The composition of the enamel should be selected such that at metal spraying temperatures, typically 900° C., the outer skin of the enamel is softened so that partial penetration of the outer skin by the sprayed metal takes place leading to good adhesion. The enamel should not be so soft that the particles of the metal spray penetrate through the vitreous enamel to contact the underlying steel structure as this would cause a marked local reduction of the level of insulation. While not a serious risk it is one best avoided.

One way of reducing the penetration of the enamel layer is to use lower atomized pressures. This has the effect of reducing particle velocity and therefore penetration. It will be understood that the vitreous enamel referred to above is a glassy material with a wide softening range. Such materials are particularly suited to this application because they are strong at room temperature, adhere strongly to steel, are relatively soft at the spraying temperature of the applied metal so allowing partial penetration of the spray particles, have good insulating properties and are stable at high temperatures. The composition of the enamel is chosen with care to suit each special circumstance having regard to the temperature and other conditions of its application and of the intended use of the structure.

While the above procedures have been described particularly in connection with sprayed cupro-nickel coatings for protection under marine conditions, it will be understood that the same procedures can be used with metals and alloys other than cupro-nickel. The composite structure can also be used with benefit in situations other than a marine environment where corrosion protection is important. The composite structure can also be used as, for example, where a metal coating is required to be Insulated from a conducting surface/substrate, for example heavy duty printed circuit boards and resistive coatings which heat up when a current is passed through them. Metal coatings can be protected by applying a second enamel coating on top of sprayed metal in order to encapsulate it.

BRIEF DESCRIPTION OF THE DRAWINGS

A method and a product according to the invention are illustrated in the accompanying diagrammatic drawings in which.

DETAILED DESCRIPTION OF THE PREFERRED EMBODIMENT

Figure 1:
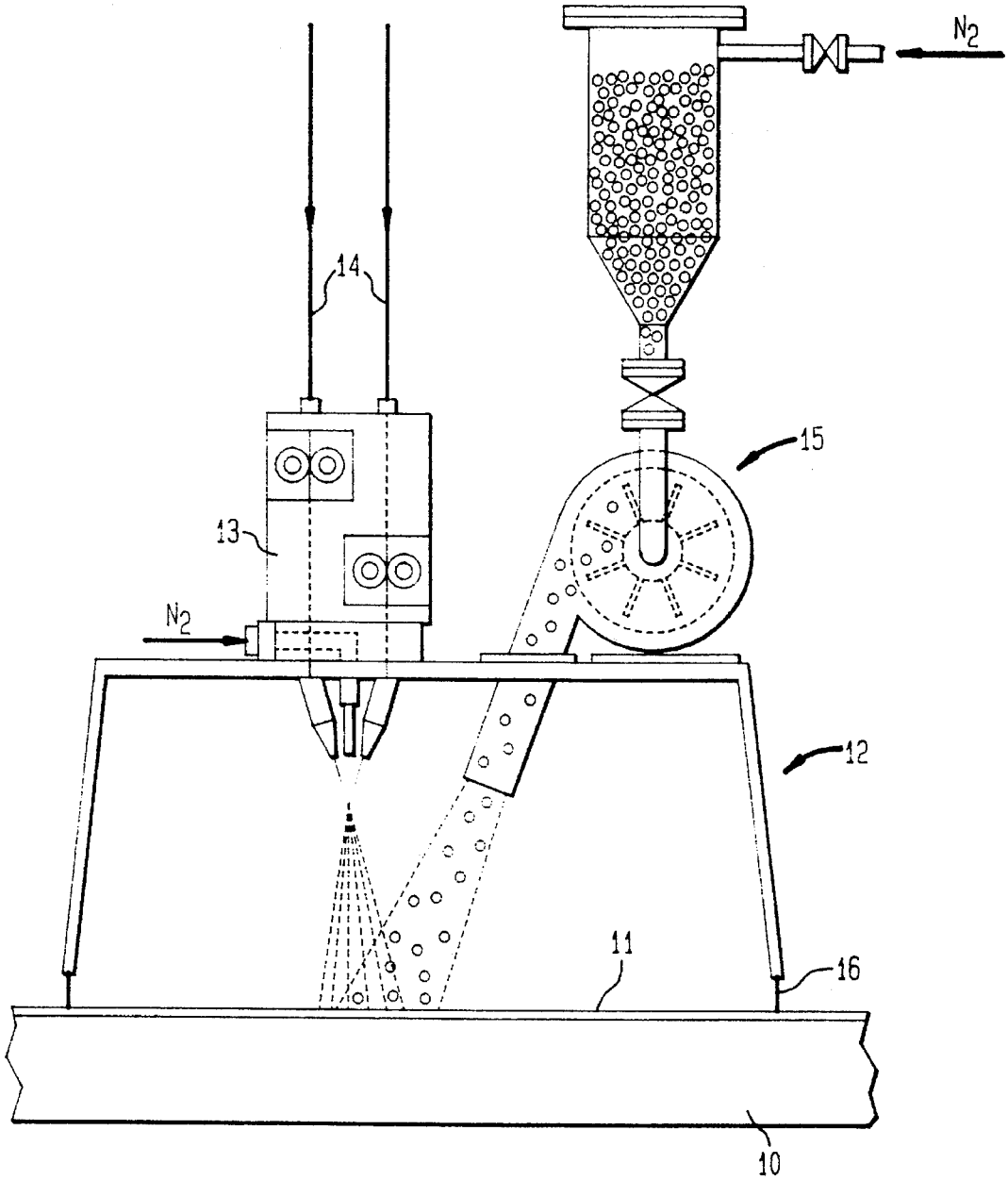
FIG. 1 shows a form of apparatus illustrating the principle of substantially simultaneous spraying and peening of metal on the enamelled surface.

In a preliminary step a steel plate 10 is coated with a frit of enamel which is then heated by an oxyacetylene flame to cause the enamel to flow over the hot surface of the steel and adhere strongly to it. One suitable proprietory enamel slip for this purpose is ground coat WB 6340 supplied by Ferro (UK) Ltd. While the enamel layer 11 and the steel surface are still hot, a shroud 12 is placed over the enamel layer as shown in FIG. 1, and within the shroud cupro-nickel is sprayed on to the hot surface of the enamel from a wire-fed arc spray gun 13 to form a layer of cupro-nickel 3 mm in thickness. The gun 13 is of a standard design using wires 14 of the constituents of the metal sprayed but in this instance is fed with nitrogen instead of air to avoid oxidation of the cupro-nickel, the shroud operating to confine the nitrogen to the necessary extent. Also within the shroud is the nozzle of a peening gun 15 which bombards the surface of the sprayed metal with peening shot. The shot is retained by chain 16 at the lower edge of the shroud for collection and re-circulation.

The procedure in this example was to spray at each location for approximately 2 seconds without peening and then spray and peen simultaneously for approximately 10 seconds. This was done continuously by making the length of the peening "footprint" smaller than the deposition "footprint" in the arrowed direction of movement of the steel plate and following 2 seconds behind it. The metal spray during the first 2 seconds of application partially penetrated the enamel at (4) and then built up approximately 0.5 mm of spray deposit before being subjected to peening. The subsequent simultaneous spraying and peening gave a high density pore-free layer of cupro-nickel having a smooth external surface.

Figure 2:
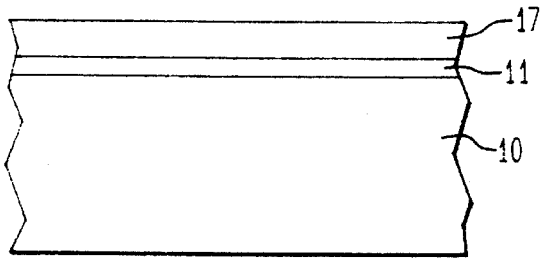
FIG. 2 shows in section the resulting structure.

The resulting layered formation is illustrated in FIG. 2 which shows the steel plate 10 coated with a fused vitreous enamel layer 11. The layer of cupro-nickel 17 is spray deposited on top of the enamel. Particles in the first portion of the deposit of cupro-nickel have partially penetrated the enamel while it was in the soft state at high temperature and have formed a strong bond with the enamel. The remaining part of the deposit has been simultaneously peened giving a dense external layer of cupro-nickel with very low internal stress. The cupro-nickel face has excellent resistance to sea water and is permanently antifouling. The cupro-nickel deposit is dense and externally smooth. Moreover, the deposition of the sprayed metal using the simultaneous spray peening process results in the external cupro-nickel surface having a low compressive internal stress, which reduces the risk of spalling caused by accidental damage and straining of the composite coating.

We claim:

1. A method of protecting a metal surface comprising the steps of:

coating the metal surface with vitreous enamel, spraying a molten atomized corrosion resistant metal or alloy while the enamel is in a heated viscous and relatively softened condition thereby to form a layer of the corrosion resistant metal or alloy bonded to the enamel, and carrying out a spray peening operation on the layer of corrosion resistant metal or alloy whilst the corrosion resistant metal or alloy is in a hot condition wherein said corrosion resistant metal is strongly adhesive to the substrate.

2. A method as claimed in claim 1, wherein said spray peening operation is carried out immediately following the application of said protective metal or alloy and while the corrosion resistant metal is still hot.

3. A method as claimed in claim 1, wherein said spray peening is carried out simultaneously with the spraying of said protective metal or alloy after a predetermined time interval during which said corrosion resistant metal or alloy is sprayed on to the hot viscous surface of the enamel without simultaneous spray peening.

4. A method as claimed in claim 1, wherein the corrosion resistant metal or metal alloy is cupro-nickel.

5. A method as claimed in claim 1, wherein a second coating of vitreous enamel is applied on top of the sprayed metal.

6. An article or structure having at least part of a metallic surface thereof coated with a vitreous enamel, the coating of enamel having applied thereto a spray-coated layer of a corrosion resistant metal or alloy, with penetration of the enamel at the interface between the enamel and the corrosion resistant metal or alloy, the protective metal or alloy layer being peened wherein said corrosion resistant metal is strongly adhesive to the substrate.

7. A structure as claimed in claim 6 for marine use wherein the corrosion resistant metal or alloy is cupronickel.

8. An article or structure as claimed in claim 6, and having a coating of enamel on the surface of the layer of corrosion resistant metal or alloy.

9. A method of protecting a metal surface comprising the steps of:

coating the metal surface with vitreous enamel, spraying a molten atomized corrosion resistant metal or alloy while the enamel is in a heated viscous and relatively softened condition thereby to form a layer of the protective metal or alloy bonded to the enamel coating, wherein early particles of said sprayed corrosion resistant metal or alloy partially penetrate the outer skin of said heated viscous and relatively soft vitreous enamel coating wherein said corrosion resistant metal is strongly adhesive to the substrate.

* * * * *